United States Patent [19]

Mitsuhashi et al.

[11] Patent Number: 4,522,907

[45] Date of Patent: Jun. 11, 1985

[54] METHOD FOR DEVELOPING LATENT IMAGES USING RESIN DONOR MEMBER

[75] Inventors: Yasuo Mitsuhashi, Yokohama; Ichiro Ohsaki, Kawasaki, both of Japan

[73] Assignee: Canon Kabushiki Kaisha, Tokyo, Japan

[21] Appl. No.: 529,125

[22] Filed: Sep. 2, 1983

Related U.S. Application Data

[63] Continuation of Ser. No. 398,543, Jul. 15, 1982, abandoned, which is a continuation of Ser. No. 204,874, Nov. 7, 1980, abandoned.

[30] Foreign Application Priority Data

| | | | |
|---|---|---|---|
| Nov. 14, 1979 | [JP] | Japan | 54-147520 |
| Nov. 14, 1979 | [JP] | Japan | 54-147521 |
| Nov. 28, 1979 | [JP] | Japan | 54-154856 |
| Dec. 26, 1979 | [JP] | Japan | 54-169572 |
| Feb. 15, 1980 | [JP] | Japan | 55-17402 |
| Aug. 6, 1980 | [JP] | Japan | 55-108741 |
| Oct. 13, 1980 | [JP] | Japan | 55-143250 |
| Oct. 13, 1980 | [JP] | Japan | 55-143255 |

[51] Int. Cl.[3] ..... G03G 13/08; G03G 15/08

[52] U.S. Cl. ..... 430/102; 430/120; 430/122; 430/902; 118/653; 361/226

[58] Field of Search ..... 430/102, 120, 122, 903; 118/653, 656, 657, 658; 361/226; 355/30 D

[56] References Cited

U.S. PATENT DOCUMENTS

| | | | |
|---|---|---|---|
| 3,526,533 | 9/1970 | Jackson et al. | 430/108 |
| 3,909,258 | 9/1975 | Kotz | 430/122 |
| 3,996,892 | 12/1976 | Parker et al. | 118/658 |
| 4,034,709 | 7/1977 | Fraser et al. | 118/658 |
| 4,053,310 | 10/1977 | Lee | 430/108 |
| 4,100,884 | 7/1978 | Mochizuki et al. | 118/653 |
| 4,103,334 | 1/1977 | Samuels et al. | 118/658 |
| 4,154,520 | 5/1979 | Nishikawa et al. | 118/658 X |
| 4,187,330 | 2/1980 | Harada et al. | 118/657 X |

FOREIGN PATENT DOCUMENTS

| | | | |
|---|---|---|---|
| 131205 | 6/1978 | Fed. Rep. of Germany | 118/653 |
| 52-94140 | 8/1977 | Japan . | |
| 54-12674 | 6/1979 | Japan . | |

OTHER PUBLICATIONS

Osterhoudt et al, "Smooth Rubber Coated Magnetic Brush Sleeve," IBM Tech. Disc. Bull., vol. 19, No. 12, May 1977, p. 4751.

Hackh's Chem. Dict., "Rubber", pp. 587-588, Nov. 1969.

*Primary Examiner*—Roland E. Martin

*Attorney, Agent, or Firm*—Fitzpatrick, Cella, Harper & Scinto

[57] ABSTRACT

A method for developing electric latent images with a triboelectrified toner without use of carrier particles therefor comprises using as a member for imparting triboelectric charges to said toner, a member containing at least on the surface at least one kind selected from poly (phenylene oxide); polycarbonate, styrene type resin, silicone resin, polymer of vinyl ester type monomer, silane compound, and polyethersulfone. Also, an apparatus for developing electric latent images comprises a toner-holding member, a means for supplying a toner to said toner-holding member and a means for moving said toner-holding member and supplying said toner to a portion for development of the electric latent images; in which at least the surface of said toner-holding member contains at least one kind selected from poly (phenylene oxide), polycarbonate, styrene type resin, silicone resin, polymer of vinyl ester type monomer, silane compound, and polyethersulfone.

12 Claims, No Drawings

METHOD FOR DEVELOPING LATENT IMAGES USING RESIN DONOR MEMBER

This is a continuation of application Ser. No. 398,543, filed July 15, 1982, now abandoned, which is a continuation of application Ser. No. 204,874, filed Nov. 7, 1980, now abandoned.

BACKGROUND OF THE INVENTION

1. Field of the Invention

The present invention is concerned with a method for developing electric latent images, and more particularly relates to a developing method in which electric latent images formed according to the electrophotographic process, electrostatic recording process and the like are developed with an insulating toner electrically charged by friction, without use of carrier particle, to obtain visible images.

2. Description of the Prior Art

Various electrophotographic processes are heretofore known as disclosed, for example in the specifications of U.S. Pat. No. 2,297,691 and British Pat. Nos. 1,165,406 and 1,165,405. In these processes, generally, electric latent images are formed on a photosensitive member utilizing a photoconductive material by various kinds of means and ways, and developed with a toner. Further, the resulting toner images are, if necessary, transferred onto an image transfer material such as paper or the like and ultimately fixed by application of heat, pressure or solvent vapor to obtain reproductions.

Methods for visualizing electric latent images with a toner are also known, including the magnetic brush method disclosed in U.S. Pat. No. 2,874,063, the cascade developing method disclosed in U.S. Pat. No. 2,618,552, the powder cloud method disclosed in U.S. Pat. No. 2,221,776, the fur brush method, liquid developing method and other various methods. Among these methods, the magnetic brush method, cascade method, liquid developing method and the like which use a developer composed mainly of a toner and carrier are particularly put into practical use in the wide field. Although these methods are excellent in providing good images in a relatively stable state, they have common drawbacks resulting from use of the two-components type developer as mentioned above, such as deterioration of the carrier and variation in the mixing ratio of the toner and carrier.

Therefore, for the purpose of avoiding such drawbacks, various developing methods are proposed, in which a one-component type developer composed only of a toner is employed. For example, a method of effecting the development with a magnetic toner having electric conductivity is disclosed in U.S. Pat. No. 3,909,258, in which method the electrically conductive, magnetic developer is supported on an electrically conductive sleeve in a cylindrical shape provided with magnetism in the inside and then brought into contact with electrostatic images to carry out the development. More particularly, the development is effected in such a manner that an electric conduction path is formed through the toner particles in the development portion between the surface of the recording material and that of the sleeve, and electric charges are led through the conduction path from the sleeve to the toner particles, and further the toner particles are then caused to adhere onto the image portion of the electrostatic images by means of the coulomb force produced between the toner particles and the image portion of the electrostatic images.

Such developing method using the electrically conductive magnetic toner is able to avoid the problems involved in the conventional methods utilizing the two-components type developer and therefore is an excellent method. However, it is inadvantageous in that since the toner is electrically conductive, the developed image is difficult to transfer electrostatically from the photosensitive member to the final supporting material such as plain paper or the like.

As for a developing method using a high resistant magnetic toner capable of being electrostatically transferred, Japanese Patent Laid Open No. 52-94140 discloses a method utilizing the dielectric polarizaton of the toner particles. Such method, however, has drawbacks that the developing speed is slow and the density of the developed image is insufficient. Therefore, many difficulties for practical use are involved in that method.

Another developing method using a high resistant magnetic toner as heretofore known is such one that the toner particles are subjected to triboelectrification, for example, by mutual friction of the toner particles and friction between the toner particles and sleeve surface, and then brought into contact with an electrostatic image-holding member to effect the development. However, this method is inadvantageous in that the triboelectrification of the toner particles is liable to become insufficient because of few frequency in contact between the toner particles and rubbing element, and the electrically charged toner particles is apt to agglomerate on the sleeve owing to the intensified coulomb force between the electrically charged toner particles and the sleeve. Therefore, also in this method, there are many difficulties for practical use.

The Applicant has previously proposed a novel developing method capable of eliminating the above-mentioned drawbacks and inadvantages, as disclosed in Japanese Patent Laid Open No. 54-43036. According to this method, a magnetic toner is very thinly coated to a sleeve and given charges by the triboelectrification. The charged toner is brought very close to an electrostatic image, but not in contact with the image, under the action of magnetic field so that they are facing each other, and consequently the development is carried out.

This developing method is able to obtain excellent images on account of, for example, that the frequency in contact between the sleeve and magnetic toner is increased and sufficient triboelectrification of the toner is made possible by very thin application of the magnetic toner onto the sleeve, that agglomeration of the toner particles is avoided and friction between the toner particles and sleeve is made sufficient by supporting the toner with the aid of the magnetic force and causing the magnet and toner to move relatively each other, and that fog is prevented from occurring in the background of the image by supporting the toner with the aid of the magnetic force and opposing the toner to the electrostatic image without any contact therebetween, to effect the development.

These developing methods using a one-component type developer composed of a magnetic toner do not require any carrier. Therefore, it is unnecessary to control the mixing ratio of the carrier and toner. Further, it is not required to conduct agitating operation for mixing sufficiently uniformly the carrier and the toner. These methods are advantageous in that the entire developing apparatus can be made simple and compact.

However, these methods have such drawbacks that the coating layer of the toner on the sleeve is apt to become non-uniform under the conditions of low humidity, and that under the condition of high humidity, particularly high temperature and high humidity, fluidity of the toner decreases and consequently the coating of the toner on the sleeve is apt to become poor and generation of triboelectric charges is liable to become difficult. Further, the moving degree of the toner on the sleeve is restricted. Therefore, differences in the density of the developed image are liable to arise between a portion of the image developed with toner remaining not consumed for the previous development and receiving friction repeatedly, and a portion developed with a toner newly replenished as a result of the toner being consumed for development. Such a phenomenon is observed, for example, in the case in which after many copies of an original having A-4 size is made, another original having a larger width, e.g. B-4 size is copied. That is, the image which is developed with a portion of the toner remaining on the toner-holding member and not having contributed to the copying of the A-4 size original is low in the image density as compared with that developed with a toner newly replenished and present at a portion of the toner-holding member having taken part in copying the same original. The cause of this phenomenon, although not clarified yet, is considered to reside in that the one-component type toner hardly moves in the right and left directions on the toner-holding member, and as a result, in the portion not having been used for development, substantially the same toner always remains to the toner-holding member and is repeatedly rotated in tha state so that new toner is not supplied and exchanged to the corresponding portion of the toner-holding member.

In addition, the developing methods involve a further problem remaining unsolved, so-called ghost phenomenon which is observed in such a case that when a solid black image is formed with a high density and then a new toner is replenished to the sleeve portion hardly having the toner thereon owing to consumption of the toner for the formation of the solid black image, the density of an image developed, immediately thereafter, with the newly replenished toner present at the corresponding portion of the sleeve is reduced.

The developing method using a one-component type insulating toner may be considered to be fundamentally similar to the method utilizing a two-component type developer in such a sense that triboelectric charges are imparted to the toner. In the former developing method, however, it is very important how the toner is uniformly coated to the toner-holding member and such a state is maintained stably. Therefore, the former developing method is largely different from the developing method using a two-components type developer containing carrier particles, also in consideration of the foregoing problems.

SUMMARY OF THE INVENTION

It is therefore a primary object of the present invention to provide a developing method which is free from the above-mentioned drawbacks and capable of achieving a stable and uniform coating of a one-component type insulating toner on a developer-holding member.

It is another object of the present invention to provide a developing method in which the toner exhibits stable chargeability and a clear and sharp image is obtained.

It is a further object of the present invention to provide a developing method in which deterioration of the developer as well as variation in the image density are little.

It is still another object of the present invention to provide a developing method in which the image density is hardly decreased even when a great number of copies are made.

It is a still further object of the present invention to provide a developing method which is able to minimize the occurring of the ghost phenomenon.

According to an aspect of the present invention, there is provided a method for developing electric latent images with a triboelectrified toner without use of carrier particles therefor which comprises using as a member for imparting triboelectric charges to said toner, a member containing at least on the surface at least one kind selected from polyphenylene oxide, polycarbonate, styrene type resin, silicone resin, polymer of vinyl ester type monomer, silane compound, and polyether sulfone.

According to another aspect of the present invention, there is provided an apparatus for developing electric latent images comprising a toner-holding member, a means for supplying a toner to said toner-holding member and a means for moving said toner-holding member and supplying said toner to a portion for development of the electric latent images, in which at least the surface of said toner-holding member contains at least one kind selected from polyphenylene oxide, polycarbonate, styrene type resin, silicone resin, polymer of vinyl ester type monomer, silane compound, and polyether sulfone.

BRIEF DESCRIPTION OF THE DRAWING

FIG. 1 is a schematic view of an example of a copying apparatus or recording apparatus embodying the developing method of the present invention.

FIG. 2 is a cross-sectional view of an embodiment of the developing process step used in the present invention.

FIG. 3 is a plane view of an original used for obtaining comparison data in Examples 18, 19 and 20, and Comparative Examples 4 and 5 given later.

DESCRIPTION OF THE PREFERRED EMBODIMENT

The developing method of the present invention will be described with reference to the drawings.

The structure of an example of a copying apparatus or recording apparatus to which the developing method of this invention can be applied is schematically illustrated in FIG. 1. Of course, this invention is not restricted to this example.

In FIG. 1, reference numeral 1 denotes a photosensitive member in a drum shape including a photoconductive layer, which member corresponds to an electrostatic image-holding member. The photosensitive member may be provided with, or not provided with an insulating layer at the surface, and further, such member may be not only in a drum shape, but also in a sheet or belt shape. Any of these types of photosensitive members may be arbitrarily used in the present invention. Numeral 2 designates a well known charging device for photosensitization. Numeral 3 indicates a light image irradiating device for projecting an original image, light image or light beam modulated by image signal.

An electrostatic image is first formed on the photosensitive member 1 by utilizing the irradiating device 3 and then formed into a visible image of toner particles on the photosensitive member 1 by means of a developing device as denoted by numeral 4, to which a developer-carrying member 4*a* is incorporated. The toner image thus obtained is transferred by a transferring device 5, to a transfer material 6.

In this case, for the purpose of improving the transferability, the visible image may be previously given electric charges prior to the transferring, for example, by corona discharge. Further, it is possible to adopt the so-called electrostatic image transferring system in which the electrostatic image on the photosensitive member 1 is first transferred once to another image-holding member and then formed into a visible image by means of the developing device 4.

The toner image is fixed onto the transfer material 6 by a fixing device 7 including at least one pair of rollers having pressurizing means or heating and pressurizing means.

After the image transfer, the photosensitive member 1 is then cleaned to remove the toner remaining thereon by a cleaning device 8, for the purpose of making the photosensitive member 1 ready for repeated used.

The developing step used in the present invention will be explained with reference to FIG. 2, in which one embodiment of the developing step is illustrated. In this drawing, the electrostatic image-holding surface 1 is caused to move in the direction of the arrow, and a multipole permanent magnet 9 is fixed so as not to be rotated. When a non-magnetic cylinder 4*b* provided with a coat layer of the foregoing specified material in a thickness of about 10μ on its surface to act as a developer carrier is rotated in the same direction i.e. in the direction of the arrow as that of the electrostatic image-holding surface 1, a one-component type, insulating magnetic developer 11 is then transported from a developer container 12 to the surface of the rotating non-magnetic cylinder 4*b* and coated to the surface, and further the toner particles are given electric charges of the opposite polarity to that of the charges of the electrostatic image by friction between the cylinder surface and toner particles. The thickness of the toner layer is made thin (about 30μ–300μ) and uniform in such a manner that a doctor blade 10 made of iron is placed in close vicinity to the surface of the cylinder with a distance therebetween being about 50μ–500μ and opposed to the position of one magnetic pole (S-pole in the example shown in FIG. 2) of the multipole permanent magnet 9. The rotation speed of the cylinder 4*b* is controlled so that the speed at the surface layer of the developer layer, and preferable the speed at the inside of the developer layer may become substantially equal to or close to the speed at the electrostatic image-holding surface. Instead of the doctor blade made of iron, a permanent magnet may be used to form the counter magnetic pole. Further, in the developing portion, an alternating-current bias may be applied between the developer-carrier and electrostatic image-holding surface Poly (phenylene oxide) which is used in the present invention is a compound of general formula:

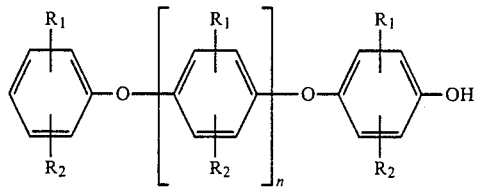

wherein $R_1$ and $R_2$ are —H, or alkyl group having not more than 12 carbon atoms and $n \geqq 20$.

A poly (phenylene oxide) of the present invention generally may be prepared by so-called oxidation coupling-reaction in which a compound of the formula:

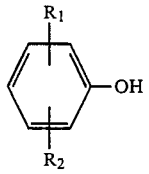

wherein $R_1$ and $R_2$ are as above stated, may be reacted with oxygen in the presence of a catalyst, such as complex of cuprous chloride-pyridine. Further, preferable monomers for the polyphenylene oxide of the invention are, for example 2,6-dimethylphenol, phenol, 2-methylphenol, 2-ethylphenol, 2-propylphenol, 2,6-diethylphenol, 2,6-diisopropylphenol, 2,5-dimethylphenol, 3,5-dimethylphenol, etc. As for poly (phenylene oxide) of the invention, all compounds containing poly (phenylene oxide) group in the structure, which are graft-copolymerized with styrene, etc. may be effectively used.

Polycarbonate used in the invention includes all carbonates as defined by the formula of

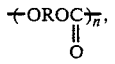

which may be prepared by the process e.g. condensation-polymerization of an aliphatic or aromatic dihydroxy compounds with phosgen in the presence of an acid, condensation-polymerization of dihydroxy compound with bischloroformate of dihydroxy compound in the presence of an acid, condensation-polymerization of monochloroformate of dihydroxy compound.

Preferable dihydroxy compounds are bis (4-hydroxyphenyl) alkanes, such as 2,2-bis (4-hydroxyphenyl) propane, 2,2-bis (4-hydroxyphenyl) butane, 1,1-bis (4-hydroxyphenyl) ethane, 1,1-bis (4-hydroxyphenyl) methane, 1,1-bis (4-hydroxyphenyl) butane, 1,1-bis (4-hydroxyphenyl) cyclohexane, 1,1-bis (4-hydroxyphenyl) cyclopentane, 2,2-bis (3,5-dichloro-4-hydroxyphenyl) propane, 2,2-bis (3,5-dichiloro-4-hydroxyphenyl) methane, etc.

Styrene type resin being applicable to the invention includes homopolymers of styrene, styrene substitution products or styrene derivatives, and copolymers thereof with other vinyl type monomers. The monomers constituting the styrene type resin of the invention are, for example, styrene, P-chlorostyrene, α-methylstyrene, vinylnaphthalene, etc, while vinyl type monomers of the invention are vinyl type monocarboxylic acids and their substitution products, e.g. esters, such as acrylic acid methyl acryrate, ethyl acryrate, butyl acryrate, propyl acryrate, dodecyl acryrate 2-chloroethylacryrate, phenylacryrate, methyl α-chloroacryrate, methacryrate, methylmethacryrate, ethylmethacryrate, butylmethacryrate, laurylmethacryrate, acrylonitrile, acrylamide; vinyl type dicarboxylic acids and derivatives thereof such as butylmaleate, dimethylmaleate, dibutylmaleate; vinylketones such as vinylmethylketone, vinylhexylketone; vinylethers such as vinylmethyleter, vinylethylether, vinyl-iso-butylether; halogenated vinylidenes such as vinylidene chloride, vinylidene chlorofluoride; N-vinyl compounds such as N-vinylpyrrole, N-vinylcarbazole, N-vinylindole, N-vinylpyrrolidone; ethylene series olefines such as ethylene, propylene, butylene, iso-butylene; mono-vinyl compounds such as vinyl esters, e.g. vinylfluoride, vinylchloride, vinylbromide, vinylacetate, vinylbenzoate, vinylbutyrate; compounds having two or more vinyl groups, e.g., aromatic di-vinyl compounds such as di-vinylbenzole, di-vinylnaphthalene and derivatives thereof; esters of vinyl type di-carboxylic acids such as ethylene glycol diacryrate, ethyleneglycol dimethacrylate, tetraethyleneglycol dimethacrylate, 1,3-butanediol methacrylate; other compounds having at least two vinyl groups such as divinyl ether, divinyl sulfide, divinyl sulfone.

Especially, copolymers of styrene and vinyl type monomer are preferred, and copolymers of styrene and acryl type monomer are most preferable.

Vinyl ester type monomers which may be used according to the invention are monomers have a form resulting from dehydration-condensation of vinylalcohol with acid, such as vinylchloride, vinylfluoride, vinylbromide, vinylacetate, vinylbenzoate, vinylbutyrate, vinylpropionate, etc.

Polymers synthesized with the vinyl ester type monomers include simple polymers of such type monomers and copoeymers with other comonomers, containing preferably more than 50 percent by weight of the vinyl ester type monomers. As the comonomers, those having at least one vinyl group may be used, including for example, styrene, p-cholostyrene, α-methylstyrene, vinylnaphthalene, vinyl type monocarboxylic acids and substitution product thereof such as esters for example acrylic acid, methyl acrylate, ethylacrylate, butylacrylate, propylacrylate, dodecylacrylate, 2-chloroethylacrylate, phenylacrylate, methyl α-chloroacrylate, methacrylic acid, methyl methacrylate, ethyl methacrylate, butyl methacrylate, lauryl methacrylate, acrylonitrile, methacrylonitrile, acrylamide; vinyl type dicarboxylic acid and derivatives thereof, substitution product thereof such as butylmaleate, dimethylmaleate, dibutylmaleate; vinylketones such as vinylmethylketone, vinylhexylketone; vinylethers such as vinylmethylether, vinylethylether, vinyl iso-butylether; vinylidene halogenates such as vinylidene chloride, vinylidene chlorofloride, N-vinylpyrrole, N-vinylcarbazole, N-vinylindole, N-vinylpyrrolidone; ethylene series olifines such as ethylene, propylene, butylene, iso-butylene; aromatic divinyl compounds such as divinyl benzene, divinyl naphthalene, derivatives and substitution products thereof; vinyl tape ester of dicarboxylic acid such as ethyleneglycol diacrylate, ethyleneglycol dimethacrylate, tetraethyleneglycol dimethacrylate, 1,3-butanediol methacrylate; divinyl ether; divinyl sulfide; divinyl sulfone.

Silane compound used in the present invention may be indicated by the general formula:

$$RA_n—Si—RB_m$$

wherein RA is alkoxy, acetoxy, halogen, or a group capable of being condensed and/or hydrolyzed; RB is a hydrocarbon group substituted with halogen, amino, mercapto, epoxy, or vinyl group; and n and m are 1.0–3.0.

Such silane compounds may include for example, halogen substituted silane compounds which are manufactured by substituting a hydrocarbon group in silane such as propyltrimethoxysilane, or ethyltrimethoxysilane, with chloro, fluoro, bromo, or iodo radical; vinyl silane compounds, such as vinyltrichlorosilane, vinyltriethoxysilane, vinyltrimethoxysilane, vinyl tris (β-methoxyethoxy)silane, vinyltriacetoxysilane, γ-methacryloxypropyl trimethoxysilane, γ-methacryloxypropyl tris(2-methoxyethoxy)silane, epoxysilane compounds such as β-(3,4-epoxycyclohexyl)ethyltrimethoxysilane, γ-glycideoxypropyltrimethoxysilane; aminosilane compounds such as γ-aminopropyl triethoxysilane, N-β(aminoethyl)γ-aminopropyl trimethoxysilane, N-β(aminoethyl)γ-aminopropylmethyl dimethoxy silane, poly aminosilane; γ-mercaptopropyl trimethoxysilane; and methyl trimethoxysilane.

Silane resins used in the invention are copolymers which may be produced by optional combination structural units such as, generally, $SiO_2$, $CH_3SiO_{3/2}$, $(CH_3)_2SiO$, $(CH_3)_3SiO_{1/2}$, $(C_6H_5)SiO_{3/2}$, $(C_6H_5)_2SiO$, $(C_6H_5)_3SiO_{1/2}$, $(C_2H_3)SiO_{3/2}$, $(C_6H_5)(CH_3)SiO$ and $(C_6H_5)(C_2H_3)SiO$. Those are exemplified as follows:

methylsilicone resin of a three-dimensional structure synthesized by using monomethyl trichlorosilane as a raw material by way of condensation-polymerization thereof after hydrolysis;

phenylsilicone resin of a three-dimensional structure synthesized mainly with monophenyl trichlorosilane as a raw material;

methylphenylsilicone resin of a three-dimensional structure synthesized mainly with monophenyl trichlorosilane and monomethyl trichlorosilane as raw materials;

vinylphenylsilicone resin of a three-dimensional structure synthesized mainly with monovinyl trichlorosilane and monophenyl trichlorosilane as a raw material;

polydimethylsiloxane of a two-dimensional structure synthesized by using mainly dimethyldichlorosilane as a raw material by way of condensation-polymerization thereof after hydrolysis.

Among these, silicone resin having three-dimensional structure, so called silicone varnish is most preferably. Silicone resin of the invention may also be modified with other resins.

Polyethersulfone used in the invention is polyallylene compound containing allylene units arranged together with ether and sulfone group in order or out of order. The examples of the polyallylene compounds are commercially available with the name of Udel P-1700, and P-3500 from Nissan Chemical Industry Ltd. (Japan), Victrex 100P, 200P, 300P and 600P from I.C.I. (Great Britain), and Astrel from Carborundum Co. (U.S.A.).

In the present invention, the member for imparting triboelectric charges to the insulating toner by friction is one that comes in contact with the toner to give the toner charges required for development, or to supplementarily impart charges to the toner, and is exemplified as a toner-holding member such as a sleeve; a member for controlling the thickness of the toner layer such as a doctor-blade; a scraper for removing residual toner on a sleeve after development of an image; and other flexible members provided so as to be in contact with the toner for the purpose of imparting electric charge to the toner by friction.

These members for imparting triboelectric charges to the toner may made in such a manner that a substrate, for example, a metal such as aluminum, iron, steel, stainless steel, or copper, or an elastic body such as synthesized rubber or elastomer is provided with a coating layer of the foregoing material at the surface. The shape of the toner-holding member is optional, and it may be not only a cylindrical rotator, but also a belt-like rotary member.

The method for providing a coating layer of the foregoing material on the surface of the member for imparting triboelectric charges to the toner may be carried out in every manner as conventionally known and is not restricted at all. For instance, the foregoing material is formed singly or along with a binder, into a solution, and the resulting solution is then coated on the charge-imparting member by the spraying or immersing method, and treated with heat to easily form a coating film on the member. The coating film may contain the foregoing material in an amount of at least 10% by weight, preferably more than 50% by weight.

Further, for the purpose of improving the physical properties of the foregoing material to be coated on the surface of the charge-imparting member, such as adhering property to the substrate of the member, coating property and durability, the foregoing material may contain, for example, other suitable resin, auxiliary agent for electric conduction such as carbon black etc., reinforcing material such as glass fiber, stainless steel filament, etc., chargeability controlling agent such as dye, pigment etc.; hydrophobic colloidal silica, or inorganic polymer of carbon fluoride, so far as the effect of the foregoing material is not deteriorated.

Especially, in order to coat the toner uniformly on the developer-holding member as well as to prohibit uneven coating of the toner even in the condition of low humidity, it is useful and effective to add fine particles of the inorganic polymer of carbon fluoride to the above-mentioned coating film.

By the inorganic polymer of carbon fluoride is meant an inorganic compound consisting of carbon and fluorine, more specifically, stratiform graphite type compound shown by the general formula of $(CF_x)_n$, and the compound itself is well known in the art. That compound with 100% fluorination, in other words, x in equal to one in the general formula, is called polycarbon monofluoride and is a white one.

The compound may be prepared by reacting raw carbon materials which may be, alone or in combination of petroleum coke, coal coke, native graphite, synthetic graphite, charcoal, carbon black, carbon in adhesive material, with fluoride to cause covalent bonding. For instance, it is obtained by reacting carbon black or graphite with fluorine gas at 200°–600° C. The concrete method for preparation thereof is disclosed in Ceramic 4(4), 301 (1969); Electrochemistry, 31 756–761, (1963) and ibid 35, 19–23 (1967). Inorganic polymer of carbon fluoride is innocuous solid in stratiform, while in the present invention it may be used as fine powder with preferably less than 15μ, more preferably 0.1–10μ in a particle diameter. The amount of the inorganic polymer of carbon fluoride to be added to the high molecular coating film on the surface of the developer-holding member is generally 1–60% by weight, preferably 5–50%.

The insulating toner used in the invention comprises a binder resin, and colorant, and if required, aids such as chargeability controlling agent, fixing aid caking prohibitor, all of which are well-known in the art.

For instance, the binder resin may include homopolymer of styrene or its substitution product such as polystyrene, poly-p-chlorostyrene, polyvinyltoluene; copolymer of styrene series such as copolymer(styrene-p-chlorostyrene), copolymer(styrene-vinyltoluene), copolymer(styrene-vinylnaphthalene), copolymer(styrene-acrylic ester), copolymer(styrene-methacrylic ester); copolymer(styrene-α-chloromethacrylic ester), copolymer(styrene-acrylonitrile); copolymer(styrene-vinylethylether), copolymer(styrene-vinylmethylketone), copolymer(styrene-butadiene), copolymer(styrene-isoprene), copolymer(styrene-acrylonitrile-indene), copolymer(styrene-maleic acid); polymethylmethacrylate; polybutylmethacrylate; polyvinyl chloride; polyvinyl acetate; polyethylene; polypropylene; polyester; polyurethane; polyamide; epoxy resin; polyvinyl butyral; polyacrilic acid resin; rosin; denatured rosin; terpene resin; phenolic resin; aromatic or aliphatic hydrocarbons resin; aromatic petroleum resin; chlorinated paraffin; paraffin wxs; etc. These materials may be used alone or in combination. Other ingredients, such as colorant, chargeability controlling agent, fixing aids, and caking prohibitor, are carbon-black, various dyes and pigments, elastomer, colloidal silica, talc, and etc.

And further when the toner is used as a magnetic toner, it may contain magnetic fine particles of about 0.1–5 μm in diameter, of ferromagnetic elements, or alloys containing the elements which have been known as magnetic materials, for example iron of magnetite, hematite, ferrite, etc; alloys or compounds comprising iron, cobalt, nickel and/or manganese; or other ferromagnetic materials. Said magnetic material may be used in an amount of about 1–60% by weight based on the weight of the toner.

In the present invention, when the foregoing material is contained in a portion or the whole of the surface layer of the member such as a sleeve which gives triboelectric charge to the one-component type developer, clear and sharp images with high image density are always obtained even after a large number of copies are made, in comparison to the case wherein such material is not contained. Similarly, there is hardly observed such a phenomenon that after a great number of copies of an original having a smaller width are made, when another original having a larger width is copied, the density of the developed images is decreased at the area of enlarged width. Furthermore in the developing step using the one-component type developer, it is coated and spread uniformly over the developer-holding member by means of a controlling member such as a conventional doctor blade. However, in some cases, the developer is tightly held on the surface of the developer-holding member so that uniform coating of the developer cannot be achieved even by utilizing the controlling member, and therefore unevenness occurs in the coating. On the contrary, in the present invention such unevenness in the coating hardly occurs.

The following examples are given by way of illustration of the invention.

EXAMPLE 1

A mixture including 100 parts by weight of zinc oxide, 20 parts by weight of (styrene-butadiene) copolymer, 120 parts by weight of toluene, and 4 parts by weight of a methanol solution containing 1% by weight of Rose Bengal was dispersed and mixed in a ball mill for 6 hours. The resulting mixture was applied by a wire-bar onto a drum made of aluminum plate of 0.05 mm in thickness up to 40 microns in thickness after dried. Solvents in the mixture were evaporated by warm air to form a photosensitive member of zinc oxide binder type. After corona discharge of −6 KV was applied onto the photosensitive member to charge uniformly the whole surface thereof, an imagewise exposure was carried out to form an electrostatic latent image. On the other hand, a solution containing 2 parts by weight of poly (phenylene oxide) synthesized from 2, 6-dimethyl phenol and 100 parts by weight of toluene was applied onto a surface of an aluminum cylinder of 50 mm in outside diameter, and dried in an atmosphere of 70° C. for 1 hour to form a poly(phenylene oxide) layer of about 20 microns in thickness.

The cylinder thus obtained was used as the sleeve. And, there was used a developing device in which the sleeve thereof was rotated and the magnet thereof was fixed (the peripheral speed of the sleeve was equal to that of the drum, and the rotating direction of the sleeve was opposite to that of the drum), in which a density of flux of magnetic force on the surface of the sleeve was 700 gauss, and in which a distance between a blade and the surface of the sleeve was 0.2 mm. The developing device was set so that a distance between the surfaces of said photosensitive drum and the sleeve was 0.25 mm. Onto the sleeve was applied an AC of 600 V and 200 Hz, and a DC bias of −150 V to develop said image by a developer including 100 parts by weight of (styrene-butyl acrylate) copolymer, 60 parts by weight of magnetic powder, and 0.3 parts by weight of hydrophobic colloidal silica. Then, the resulting powder image was transferred to a transfer paper with irradiation of DC corona of −7 KV from the back side of the paper, and the transferred image was fixed by use of a heated roll. The fixed image was clear, sharp, excellent in the resolution, and free from fog. The potential of the toner layer on the sleeve was measured with a surface electrometer. The potential was +30 V. Also, a good fixed image was obtained even under high humid condition.

EXAMPLE 2

A solution including 3 parts by weight of (styrene-2, 6-dimethyl phenol) graft copolymer and 100 parts by weight of toluene was applied onto a surface of a cylinder made of stainless steel of 50 mm in outside diameter, and dried in an atmosphere of 70° C. for 1 hour to form a resin layer of about 30 microns in thickness. In a similar manner to that described in Example 1, a fixed image was obtained by use of the said cylinder. The obtained fixed image was clear, sharp and free from fog. The potential of the toner layer on the sleeve was +25 V.

Example 3

A good fixed image was obtained in the similar manner to that described in Example 1 except that a developer including 80 parts by weight of epoxy resin, 20 parts by weight of (styrene-amino ethyl methacrylate) copolymer, 80 parts by weight of magnetic powder, and 0.5 parts by weight of hydrophobic colloidal silica was used instead of the developer used in Example 1. The potential of the toner layer on the sleeve was +25 V.

EXAMPLE 4

Charge was unformly effected by corona discharge of +6 KV onto the surface of the insulating layer of a photosensitive drum which comprises an insulating layer including polyester resin, a photosensitive layer including CdS and acrylic resin, and a conductive substrate, then imagewise exposure and AC corona discharge of 7 KV were simultaneously carried out, thereafter whole surface exposure was carried out to form an electric latent image on the surface of the photosensitive member. A developing procedure was carried out in a similar manner to that described in Example 1 except that an applied bias was AC of 600 V and 200 Hz, and DC of +400 V, to obtain a reversal image which was clear and free from fog.

COMPARATIVE EXAMPLE 1

The image forming procedure was carried out in a similar manner to that described in Example 1 except that a sleeve to be used was not treated with poly(phenylene oxide), to obtain a reversal image. The potential of the toner layer on the sleeve was −25 V.

COMPARATIVE EXAMPLE 2

A good image having a slightly lower density than that obtained in Comparative example 1 was obtained in a similar manner to that described in comparative example 1 except that a positively/chargeable developer including 20 parts by weight of (styrene-butyl methacrylate-amino ethyl methacrylate) copolymer, 80 parts by weight of (styrene-butyl methacrylate) copolymer, 2 parts by weight of nigrosine, 60 parts by weight of magnetic powder, and 0.4 parts by weight of hydrophobic colloidal silica was used instead of the developer used in Comparative example 1. The potential of the toner layer on the sleeve was 15 V. However, the image forming procedure was carried out under highly/humid condition to obtain an image of very poor quality.

Maximum density (D max) of the obtained images at ordinary temperature and humidity, and at high temperature and humidity, and the potentials of the toner layer show the following table.

| | D max (25° C., 60% RH) | Potential of the toner layer | D max (35° C., 85% RH) | Potential of the toner layer |
|---|---|---|---|---|
| Example 1 | 1.32 | +30 V | 1.15 | +25 V |
| Example 2 | 1.23 | +25 V | 1.10 | +20 V |
| Example 3 | 1.25 | +25 V | 1.08 | +20 V |
| Example 4 | 1.28 | +30 V | 1.11 | +25 V |
| Comparative example 1 | — | −25 V | — | — |
| Comparative example 2 | 0.95 | +15 V | 0.31 | +5 V |

EXAMPLE 5

A solution including 3 parts by weight of polycarbonate synthesized by condensation polymerization between bisphenol A and phosgene, and 100 parts by weight of toluene was applied onto a surface of an aluminum cylinder of 50 mm in outside diameter, and dried in an atmosphere of 70° C. for 1 hour to form a sleeve having a polycarbonate layer of about 15 microns in thickness.

Also, a toner was produced with 90 parts by weight of (stylene-butyl acrylate) copolymer, 10 parts by weight of (styrene-butyl acrylate-aminoethyl/methacrylate) copolymer, 60 parts by weight of magnetic powder, and 0.3 parts by weight of hydrophobic colloidal silica. A similar image forming procedure to that described in Example 1 was carried out except that said sleeve and said developer were used.

The obtained image was clear, excellent in the resolution, and free from fog. The potential of the toner layer on the sleeve was measured with a surface electrometer. The potential was +30 V. After copying one thousand sheets of A-4 size, the copying was carried out with B-4 size paper. However, there could by recognized no noticeable phenomenon of the image density to become thin for the portion broader than the A-4 size.

EXAMPLE 6

The image forming procedure was carried out in a similar manner to described in Example 5 except that a polycarbonate layer of about 20 microns in thickness was provided on the surface of iron blade 10 shown in FIG. 2 and a cylinder made of stainless steel of 50 mm in outside diameter was used as the sleeve. The potential of the toner layer on the sleeve was +25 V.

EXAMPLE 7

An image forming procedure was carried out in a similar manner to described in Example 5 except for use of the procedure and materials to be described below.

A developer used was prepared with 100 parts by weight of polyethylene having low molecular weight, 80 parts by weight of magnetic powder, 2 parts by weight of metallized dye, and 0.6 parts by weight of hydrophobic colloidal silica.

An electric latent image was formed on the surface of the following photosensitive member by the following procedure: charge was uniformly effected by corona discharge of +6 KV onto a surface of an insulating layer of a photosensitive drum including the insulating layer of polyester resin, a photosensitive layer of CdS and acrylic resin, and a conductive substrate, then AC corona discharge of 7 KV was simultaneously carried out with imagewise exposure, thereafter whole surface exposure was carried out; to the sleeve was applied AC of 200 Hz and 600 V, and DC bias of +150 V, then the obtained electrostatic latent image was transferred to a paper.

The obtained image was free from fog and clear. The potential of the toner layer on the sleeve was −25 V.

COMPARATIVE EXAMPLE 3

The image forming procedure was repeated in a similar manner to that described in Example 5 except that the polycarbonate layer was absent on the sleeve to obtain an image having slightly low density and being free from fog. The potential of the toner layer on the sleeve was +20 V. After copying one thousand sheets of A-4 size, the copying was carried out with B-4 size paper. In this case, there could be recognized noticeable phenomena of the image density to become thin for the portion broader than the A-4 size.

| | Initial D max | D max (A-4)* | D max (B-4)** |
|---|---|---|---|
| Example 5 | 1.25 | 1.21 | 1.18 |
| Example 6 | 1.14 | 1.11 | 1.06 |

-continued

| | Initial D max | D max (A-4)* | D max (B-4)** |
|---|---|---|---|
| Example 7 | 1.38 | 1.27 | 1.21 |
| Comparative example 3 | 0.98 | 0.75 | 0.31 |

*D max of one thousandth sheet of A-4 size.
**D max of initial sheet of B-4 size, after copying of A-4 size, for a portion broader than the A-4 size.

EXAMPLE 8

A solution including 2 parts by weight of (styrene-methyl methacrylate) copolymer (mole ratio 7:3) and 100 parts by weight of toluene was applied onto a surface of a cylinder of stainless steel with an outside diameter of 50 mm, and dried in an atmosphere of 70° C. for 1 hour to form a sleeve having a (styrene-methyl methacrylate) copolymer layer of about 10 microns in thickness.

The image forming procedure was carried out in a similar manner to that described in Example 5 except for use, of said sleeve. The obtained image was clear, excellent in the resolution, and free from fog. It was found by measurement with an electrometer that the potential of the toner layer of the sleeve was +25 V.

After copying one thousand sheets of A-4 size, the copying was carried out with B-4 size paper. In this case, it was little observed that the density (D max) of the image became thin for the portion broader than the A-4 size.

EXAMPLE 9

A toluene solution containing 3 percent by weight of (styrene-acrylonitrile) copolymer (mole ratio 8:2) was applied onto a surface of a cylinder of stainless steel with an outside diameter of 50 mm to obtain a resin layer of 15 microns in thickness.

The image forming procedure was carried out in a similar manner to that described in Example 8 except for use of the above-mentioned sleeve. The obtained result was similar to that described in Example 8.

EXAMPLE 10

The image forming procedure was carried out in a similar manner to that described in Example 8 except that polystyrene was used instead of (styrene-methyl methacrylate) copolymer. The obtained image was clear, sharp and free from fog.

EXAMPLE 11

The image forming procedure was carried out in a similar manner to that described in Example 8 except that a (styrene-methyl-methacrylate) copolymer layer of about 20 microns in thickness was provided on the surface of iron blade 10 shown in FIG. 2. The obtained image was clear and sharp. After copying one thousand sheets of A-4 size, the copying was carried out with B-4 size paper. However, it was little observed that the density (D max) of the image became thin for the portion broader than the A-4 size.

EXAMPLE 12

The image forming procedure was carried out in a similar manner to that described in Example 8 except that (styrene-butyl maleate-di-vinyl benzene) copolymer (monomer ratio 65:34.5:0.5) was used instead of (styrene-methyl methacrylate) copolymer to obtain a good result.

EXAMPLE 13

An image forming procedure was carried out in a similar manner to described that in Example 8 except that procedure and materials were used to be described below.

A developer used was prepared with 100 parts by weight of polyethylene having low molecular weight, 80 parts by weight of magnetic powder, 2 parts by weight of metallized dye, and 10 parts by weight of hydrophobic colloidal silica.

An electric latent image was formed on the surface of the following photosensitive member by the following procedure: charge was uniformly effected by corona discharge of +6 KV onto a surface of an insulating layer of a photosensitive drum including the insulating layer of polyester resin, a photosensitive layer of CdS and acrylic resin, and a conductive substrate; AC corona discharge of 7 KV was simultaneously carried out with imagewise exposure, thereafter whole surface exposure was carried out; to the sleeve was applied AC of 200 Hz and 600 V, and DC bias of +150 V; then the obtained electrostatic latent image was transferred to a paper.

The obtained image was free from fog and clear. The potential of the toner layer on the sleeve was −20 V.

| | Initial D max | D max (A-4)* | D max (B-4)** |
|---|---|---|---|
| Example 8 | 1.21 | 1.15 | 1.10 |
| Example 9 | 1.23 | 1.20 | 1.17 |
| Example 10 | 1.25 | 1.21 | 1.15 |
| Example 11 | 1.31 | 1.30 | 1.28 |
| Example 12 | 1.21 | 1.17 | 1.14 |
| Example 13 | 1.23 | 1.18 | 1.07 |

*D max of one thousandth sheet of A-4 size.
**D max of initial sheet of B-4 size, after copying of A-4 size, for a portion broader than the A-4 size.

EXAMPLE 14

A poly (vinyl acetate) layer of about 10 microns in thickness was formed on a surface of a cylinder of stainless steel having an outside diameter of 50 mm by dipping method into a toluene solution containing 3 percent by weight of poly (vinyl acetate) (trade name: Gohsenyl N8 - 2, supplied by Nihon Gosei Chemical Industrial Co. Ltd.). The coated cylinder was used as the sleeve.

Charge was uniformly effected by corona discharge of +6 KV onto a surface of an insulating layer of a photosensitive drum including the insulating layer of polyester resin, a photosensitive layer of CdS and acrylic resin, and a conductive substrate; then AC corona discharge of 7 KV was simultaneously carried out with imagewise exposure, thereafter whole surface exposure was carried out to form an electric latent image on the surface of the photosensitive member.

The cylinder having said poly (vinyl acetated) coated layer was used as the sleeve. And, there was used a developing device in which the sleeve thereof was rotated and the magnet thereof was fixed (the peripheral speed of the sleeve was equal to that of the drum, and the rotating direction of the sleeve was opposite to that of the drum), in which a density of flux of magnetic force on the surface of the sleeve was 700 gauss, and in which a distance between the blade and the surface of the sleeve was 0.2 mm. The developing device was set in such manner that a clearance between the surface of said photosensitive drum and the sleeve was 0.25 mm. Onto the sleeve was applied an AC of 200 Hz and 600 V, and a DC bias of 150 V to develop said electrostatic latent image by a developer including 100 parts by weight of (styrene-butyl acrylate) copolymer, 50 parts by weight of magnetic powder, and 0.4 parts by weight of hydrophobic colloidal silica. Then, the resulting powder image was transferred to a transfer paper with irradiation of DC corona of 7 KV from the back side of the paper, and the transferred image was fixed to obtain a copied image. Further, the developer remaining on the photosensitive drum was removed by a magnetic bruch cleaner.

The obtained image was clear, excellent in the resolution, and free from fog. Even in such case that the image forming procedure was carried out under low humidity (25° C., 35% RH) the obtained image was good and even. After copying one thousand sheets of A-4 size paper, the copying was carried out with B-4 size paper. In this case, there could be recognized no noticeable phenomenon of the image density to become thin for the portion broader than the A-4 size.

EXAMPLE 15

By use of a methyl ethyl ketone solution including 4 parts by weight of (Vinyl chloride-vinyl acetate) copolymer (trade name, Slec C; supplied by Sekisui Chemical Co. Ltd.) was formed a layer of (Vinyl chloride-vinyl acetate) copolymer having a thickness of about 15 microns on a surface of a stainless steel cylinder of 50 mm in outside diameter, the obtained cylinder was used as the sleeve. A mixture including 100 parts by weight of zinc oxide, 20 parts by weight of (styrene-butadiene) copolymer, 40 parts by weight of poly (n-butyl methacrylate), 120 parts by weight of toluene, 4 parts by weight of a methanol solution containing 1% by weight of Rose Bengal was dispersed and mixed in a ball mill for 6 hours. The resulting mixture was applied onto a drum made of aluminum plate of 0.05 mm in thickness up to 40 microns in thickness after dried. Solvents in the mixture were evaporated by warm air to form a photosensitive member of zinc oxide binder type. After corona discharge of −6 KV was applied to the photosensitive member to charge uniformly the whole surface thereof, an imagewise exposure was carried out to form an electrostatic latent image.

Onto said sleeve was applied an AC of 200 Hz and 600 V, and a DC bias of −150 V to develop said latent image by use of the same developing device having said sleeve as that described in Example 14, and by use of a developer containing 90 parts by weight of (styrene-butyl acrylate) copolymer, 10 parts by weight of (styrene-butyl acrylate-amino ethyl methacrylate) copolymer, 70 parts by weight of magnetic powder, and 0.5 parts by weight of hydrophobic colloidal silica. Then, the obtained powder image was transferred to a transfer paper with irradiation of DC corona of −7 KV from the back side of the paper to obtain a copied image. The obtained image was free from fog and clear. Even in such case that the image forming procedure was carried out under low humid condition (25° C., 35% RH), the obtained image was good and even. After copying one thousand sheets of A-4 size, the copying was carried out with B-4 size paper. In this case, it was little observed that the image density become thin for the portion broader than the A-4 size.

EXAMPLE 16

A similar procedure to that described in Example 15 was carried out except that (vinyl chloride-vinyl acetate-maleic acid) copolymer was used instead of (vinyl chloride-vinyl acetate) copolymer (trade name, Slec M*, supplied by Sekisui Chemical Co. Ltd.) to obtain a similar result to that described in Example 15.

EXAMPLE 17

A similar procedure to that described in Example 14 was carried out except that (ethylene-vinylacetate) copolymer (trade name, Soarlex R, supplied by Nihon Gosei Chemical Industrial Co. Ltd.) was used instead of poly (vinyl acetate), to obtain a good result.

| | Initial D max | D max (A-4)* | D max (B-4)** |
|---|---|---|---|
| Example 14 | 1.28 | 1.21 | 1.18 |
| Example 15 | 1.22 | 1.14 | 1.10 |
| Example 16 | 1.27 | 1.22 | 1.17 |
| Example 17 | 1.21 | 1.16 | 1.11 |

*D max of one thousandth sheet of A-4 size.
**D max of initial sheet of B-4 size, after copying of A-4 size, for a portion broader than the A-4 size.

EXAMPLE 18

An aluminum cylinder of 50 mm in outside diameter was immersed in an aqueous solution of 5 percent by weight of N-$\beta$ (aminoethyl) $\gamma$-aminopropyl trimethoxysilane, drawn up, and sufficiently dried to obtain the cylinder whose surface was treaded with N-$\beta$ (aminoethyl) $\gamma$-aminopropyltrimethoxysilane. The treated cylinder was used as the sleeve. The image forming procedure was carried out in a similar manner to that described in Example 14 except for use of the above-mentioned sleeve and an insulating magnetic developer containing 50 parts by weight of (styrene-butyl acrylate) copolymer, 50 parts by weight of (styrene-maleic acid) copolymer, 60 parts by weight of magnetic powder, and 2 parts by weight of metallized dye. The obtained image had good reproducibility in fine line and high density of image. Further, the transferred image after copying 100,000 sheets showed no deterioration and had the same high density as that of the initial image. Even in case of forming image under high humid condition (30° C., 85% RH) in the same manner as described above, the image density little lowered and the obtained image was good.

The image forming procedure was carried out by use of the original shown in FIG. 3, and in this case the portion including white and black portions was used as the head of the origanal. Then, comparison of the image density was carried out concerning solid black portion 2 contiguous to solid black portion 1 and solid black portion 4 contiguous to white portion 3, and difference of image density between the two solid black portions, 2 and 4, was almost absent. The length of a shown in FIG. 3 is 160 mm which is equal to the circumference of the sleeve having a diameter of 50 mm. Length of b was 210 mm, and c 297 mm.

EXAMPLE 19

An aluminum cylinder of 50 mm in outside diameter was immersed in a solution including 5 parts by weight of nylon-copolymer (trade name, Elvamiade 8061, supplied by E. I. du Pont), 1 part by weight of $\gamma$-glycidoxypropyltrimethoxysilane, and 100 parts by weight of toluene, drawn up, and sufficiently dried to obtain a cylinder whose surface was coated by the film made of the mixture of nylon-copolymer and $\gamma$-glycidoxypropyltrimethoxysilane, and having a thickness of about 15 microns. The image forming procedure was carried out in a similar manner to that described in Example 18 except that the above-mentioned cylinder was used as a sleeve. The obtained image was clear, sharp, and free from ghost image and fog in similar to that obtained in Example 18.

EXAMPLE 20

A cylinder made of stainless steel having an outside diameter of 50 mm was immersed in a solution including 3 parts by weight of polystyrene (trade name, Picolastic D-125, supplied by Esso Standard Co.), 0.7 parts by weight of 3-chloropropyl trimethoxy silane and 100 parts by weight of toluene, drawn up, and dried to obtain a cylinder having a thickness of 10 microns whose surface was coated by the film made of the mixture of polystyrene and 3-chloropropyltrimethoxysilane. The obtained cylinder was used as the sleeve.

The image forming procedure was carried out in a similar manner to that described in Example 5 except for use of the foregoing sleeve. The obtained image was clear, excellent in the resolution, and substantially free from fog and ghost phenomenon. Even in the case of using other silane compounds than the foregoing silane compounds, the obtained result was similar to that described above.

COMPARATIVE EXAMPLE 4

The image forming procedure was carried out in a similar manner to that described in Example 18 except that the coated layer of N-$\beta$ (aminoethyl) $\gamma$-aminopropyltrimethoxysilane was absent on the sleeve. In an obtained image, the image density in solid black portion 2 contiguous to solid black portion 1 was lower than that in solid black portion 4 contiguous to white black 3, in other words, the obtained image showed ghost image.

COMPARATIVE EXAMPLE 5

The image forming procedure was carried out, in similar manner to that described in Example 20 except that the coated layer of resin was absent on the sleeve. The obtained image had ghost image, in other words, the density in the solid black 2 was lower than that in the solid black 4.

The foregoing comparative data were listed in the following table.

| | D max on solid black 1 | D max on solid black 2 | D max on solid black 4 |
|---|---|---|---|
| Example 18 | 1.32 | 1.28 | 1.33 |
| Example 19 | 1.36 | 1.30 | 1.36 |
| Example 20 | 1.22 | 1.19 | 1.26 |
| Comparative example 4 | 1.30 | 0.89 | 1.27 |
| Comparative Example 5 | 1.15 | 0.72 | 1.13 |

EXAMPLE 21

A solution containing 8 parts by weight of polyethersulfone (trade name, Victrex 100P, supplied by I.C.I.) and 100 parts by weight of methylene chloride was applied onto a surface of an aluminum cylinder of 50 mm in outside diameter, and dried in an atmosphere of 70° C. for 1 hour to form a polyethersulfone layer of about 10 microns in thickness, and the resulting cylinder was used as the sleeve.

The image forming procedure was carried out in a similar manner to that described in Example 5 except for use of the foregoing sleeve.

The obtained image was clear, highly excellent in the resolution, and free from fog. The potential of the toner on the sleeve showed +35 V as measured with an electrometer. After copying of 100 times by paper of A-4 size, copying was carried out by paper of B-4 size. However, it could not be recognized that the image density became thin for the portion broader than the A-4 size.

EXAMPLE 22

The same image forming procedure as described in Example 21 was carried out except that a polyethersulfone layer of about 10 microns in thickness was provided on the surface of iron blade 10 shown in FIG. 2 and that a cylinder made of stainless steel having an outside diameter of 50 mm was used as the sleeve. A good image was obtained. The potential of the toner layer on the sleeve was +25 V.

EXAMPLE 23

The image forming procedure was carried out in a similar manner to that described in Example 21 except that the developer used including 100 parts by weight of polyethylene having low molecular weight, 70 parts by weight of magnetic powder, 10 parts by weight of metallized dye, and 0.6 parts by weight of hydrophobic colloidal silica, and that the pressure developing device used had a rigid roller which pressure of 30 Kg/cm was applied to. The obtained image was clear and free from fog. The potential of the toner image on the sleeve was +25 V.

| | Initial D max | D max (A-4)* | D max (B-4)** |
|---|---|---|---|
| Example 21 | 1.32 | 1.26 | 1.21 |
| Example 22 | 1.15 | 1.10 | 1.04 |
| Example 23 | 1.25 | 1.15 | 1.02 |

*D max of one thousandth sheet of A-4 size.
**D max of initial sheet of B-4 size, after copying of A-4 size, for a portion broader than the A-4 size.

EXAMPLE 24

An aluminum cylinder of 50 mm in diameter was washed and defatted with trichlene, dried, immersed in monomethylpolysiloxane (trade name: X-12-917: supplied by Shinetsu Chemical Industrial Co. Ltd.), drawn up, and subjected to a heat treatment of 80° C. for 30 minutes, to obtain a cylinder having a monomethylsilicone coat of about 10 microns in thickness. The cylinder was used as the sleeve. The image forming procedure was carried out in a similar manner to that, described in Example 5 except for use of said sleeve.

The obtained image was clear, highly excellent in the resolution, and free from fog. Even under high humid condition, the image density lowered slightly. And, even under low humid condition, the toner was uniformly applied onto the sleeve.

EXAMPLE 25

A cylinder made of stainless steel having an outside diameter of 50 mm was immersed in a solution including 10 parts by weight of silicone resin (trade name; KR200, supplied by Shinetsu Chemical Industrial Co. Ltd.), 90 parts by weight of styrene-acrylic resin, and 900 parts by weight of toluene, drawn up, and sufficiently dried at 80° C. Then, the temperature was gradually raised up to 200° C., and a heat treatment was carried out at this temperature to obtain a cylinder having a coated film of about 15 microns in thickness. The resulting cylinder was used as the sleeve.

On the other hand, a mixture of 100 parts by weight of polyethylene and 80 parts by weight of magnetic powder was used as the developing powder.

The latent image forming process and the development were carried out in a similar manner to that described Example 24 except for use of said developing powder and said sleeve, then the obtained image was transferred onto a paper to obtain a transferred image.

The paper having the transferred image was allowed to pass through a couple of rolls applied by pressure of 15 Kg/cm to obtain a fixed image. The fixed image was clear, excellent in the resolution, and free from fog. Even under high humid condition, the image density lowered slightly. And, even under low humid condition, the toner was uniformly applied onto the sleeve. The same image forming procedure as described above was carried out except that phenylsilicone varnish (trade name, KR-216, supplied by Shinetsu Chemical Industrial Co. Ltd.) was used instead of the silicone resin to obtain a substantially same result as described above.

EXAMPLE 26

A cylinder made of stainless steel having an outside diameter of 50 mm was immersed in a solution including 250 parts by weight of silicone modified epoxy resin (trade name, ES 1001, supplied by Shinetsu Chemical Industrial Co. Ltd.) and 750 parts by weight of xylene, drawn up, and sufficiently dried at 80° C. Then, the temperature was gradually raised up to 150° C., and curing was carried out at this temperature for 20 minutes. The obtained cylinder had a coat of about 15 microns in thickness, and the cylinder was used as the sleeve.

The image forming procedure was carried out in a similar manner to that described in Example 24 except for use of said sleeve. The obtained image was clear and free from fog. Even under low humid condition, the toner was uniformly applied onto the sleeve.

There were obtained substantially same effects as above, when the same procedure as described above was carried out except that silicone modified alkyd resin (trade name, TSR-180, supplied by Toshiba-Silicone Co. Ltd.), silicone modified polyester resin (trade name, TSR-187, supplied by Toshiba-Silicone Co. Ltd.), silicone modified acrylic resin (trade name, TSR-171, supplied by Toshiba-Silicone Co. Ltd.) or silicon modified urethan resin (trade name, TSR-175, supplied by Toshiba-Silicone Co. Ltd.) were used as silicone modified resin, and that CR-35 (supplied by Toshiba-Silicone Co. Ltd.) was used as curing agent.

COMPARATIVE EXAMPLE 6

The image forming procedure was carried out in a similar manner to that described in Example 25 except that the coated layer containing silicone resin and styrene-acrylic resin was absent on the sleeve. The obtained image density was very thin, and the toner applied onto the sleeve had a ripple-like irregularity. When copying was continuously repeated for about 50 sheets, fog became hard and the copied image was reversed.

| | Initial image density under 20° C. and 60% RH | Initial image density under 20° C. and 30% RH | Initial image density under 35° C. and 80% RH |
|---|---|---|---|
| Example 24 | 1.15 | 1.20 | 1.10 |
| Example 25 | 1.21 | 1.24 | 1.14 |
| Example 26 | 1.18 | 1.19 | 1.11 |
| Comparative example 6 | 0.44 (uneven) | (very uneven unacceptable) | 0.40 |

EXAMPLE 27

An aluminum cylinder of 50 mm in diameter was immersed in a coating suspension in which 8 parts by weight of poly (phenylene oxide) synthesized from 2,6-dimethyl phenol and 2 parts by weight of inorganic polymer of carbon fluoride (trade name, FC-100, supplied by Nihon Carbon Co. Ltd.) were dissolved and dispersed in 90 parts by weight of chloroform, drawn up, and dried to obtain a cylinder having a coated layer of about 10 microns in thickness. The obtained cylinder was used as the sleeve.

The image forming procedure was carried out, in a similar manner to that described in Example 5 except for use of the above-mentioned sleeve, and the obtained image was clear, excellent in the resolution, and free from fog. The toner was uniformly and densely applied onto the sleeve. Even under low humid condition, the toner was uniformly applied onto the sleeve. Even under high humid condition, the image density lowered slightly. Further, after the image forming procedure was repeated for 10,000 sheets, the obtained image had high density, the toner was uniformly applied onto the sleeve in a state of a thin layer, and no fusion-bonding of the toner was observed on the sleeve.

EXAMPLE 28

An aluminum cylinder of 50 mm in diameter was immersed in a coating suspension in which 7 parts by weight of (styrene-acryl) copolymer type resin (trade name, Ionac X-230, supplied by Ionac Chemical Co. Ltd.) and 3 parts by weight of inorganic polymer of carbon fluoride (trade name, FC-100, supplied by Nihon Carbon Co. Ltd.) were dissolved and dispersed in 90 parts by weight of methyl ethyl ketone, drawn up, and dried to obtain a cylinder having a coated layer of about 15 microns in thickness. The obtained cylinder was used as the sleeve.

The image forming procedure was carried out in a similar manner to that described in Example 27 except for use of the foregoing sleeve to obtain a good image. There was obtained a substantially same result as described in Example 27.

EXAMPLE 29

An aluminum cylinder of 50 mm in diameter was immersed in a coating suspension in which 10 parts by weight of polyethersulfone (trade name, VICTREX 300P, supplied by I. C. I. Japan Co. Ltd.), 1 part by weight of inorganic polymer of carbon fluoride (trade name, FC-100, supplied by Nihon Carbon Co. Ltd.) were dissolved and dispersed in 90 parts by weight of methylene chloride, drawn up, and dried to obtain a cylinder having a coated layer of about 10 microns. The obtained cylinder was used as the sleeve.

The image forming procedure was carried out in a similar manner to that described in Example 27 except for use of the foregoing sleeve to obtain a good image. The obtained result was similar to that described in Example 27.

EXAMPLE 30

A cylinder made of stainless steel having a diameter of 50 mm was immersed in a coating suspension in which 7 parts by weight of methylsilicone varnish (trade name, KR-220, supplied by Shinetsu Chemical Industrial Co. Ltd.) and 3 parts by weight of inorganic polymer of carbon fluoride (trade name, FC-100, Nihon Carbon Co. Ltd.) were dissolved and dispersed in 90 parts by weight of toluene, drawn up, and dried to obtain a cylinder having a coating layer of about 10 microns in thickness. The obtained cylinder was used as the sleeve.

EXAMPLES 31–33

Sleeves having coated layers containing methylsilicone varnish and carbon fluoride were obtained in a similar manner to that described in Example 30 except that the ratio by weight of the methylsilicone varnish to the inorganic polymer of carbon fluoride were changed to 95:5, 90:10, and 50:50.

The image forming procedures were carried out in a similar manner to that described in Example 27 except that the sleeves obtained by Examples 30–33 were used.

Good results were obtained with the inorganic polymer of carbon fluoride in its content of from 5 to 50 percent by weight in the coated layer.

| | Initial Image Density | | | | Image Density after copying 10,000 sheets |
|---|---|---|---|---|---|
| | 20° C. 60% RH | 20° C. 30% RH | 35° C. 80% RH | | |
| Example 27 | 1.32 | 1.33 | 1.18 | 1.12 | No fusion-bonding of the toner on the sleeve. |
| Example 28 | 1.29 | 1.31 | 1.13 | 1.08 | |
| Example 29 | 1.38 | 1.35 | 1.25 | 1.18 | Uniform coating of the toner on the sleeve. |

| | Composition of the coating material | | Initial Image Density | | | Image Density after copying 10,000 sheets |
|---|---|---|---|---|---|---|
| | methylsilicone | carbon fluoride | 20° C. 60% RH | 20° C. 30% RH | 35° C. 80% RH | |

-continued

| | | | | | | | |
|---|---|---|---|---|---|---|---|
| Example 31 | 95 | 5 | 1.23 | 1.29 | 1.18 | 1.05 | No fusion-bonding of the toner on the sleeve. |
| Example 32 | 90 | 10 | 1.25 | 1.29 | 1.22 | 1.12 | |
| Example 30 | 70 | 30 | 1.32 | 1.34 | 1.24 | 1.19 | Uniform coating of the toner on the sleeve. |
| Example 33 | 50 | 50 | 1.30 | 1.33 | 1.23 | 1.16 | |

What we claim is:

1. A method for developing electrostatic latent images with a triboelectrified insulating toner without the use of carrier particles therefor which comprises:

forming a toner layer by applying a toner, having a conductivity on the order of $10^{-14}$ mhos/cm or lower, thinly to a toner-holding member;

imparting triboelectric charges to said toner by the friction between the toner-holding member surface and said toner; and bringing the toner layer into facing proximity with the electrostatic latent image;

at least the surface of the toner-holding member containing 10% by weight or more of at least one member selected from the group consisting of polyphenylene oxide, polycarbonate, styrene type resin, silicone resin having a three-dimensional structure, polymer of vinyl ester type monomer, silane compound, and polyethersulfone.

2. A method according to claim 1 in which at least the surface of the toner-holding member contains 50% by weight or more of at least one member selected from the group consisting of polyphenylen oxide, polycarbonate, styrene type resin, silicone resin having a three-dimensional structure, polymer of vinyl ester type monomer, silane compound, and polyethersulfone.

3. A method according to claim 1 in which the toner is an insulating magnetic toner.

4. A method according to claim 1 in which said toner layer is formed on the toner-holding member to a thickness of 30–300$\mu$.

5. A method for developing electrostatic latent images with a triboelectrified insulating toner without the use of carrier particles therefor which comprises:

forming a toner layer by applying a toner thinly to a toner-holding member the surface of which contains finely divided particles of an inorganic polymer of carbon fluoride;

imparting triboelectric charges to said toner by the friction between the toner-holding member surface and said toner; and bringing the toner layer into facing proximity with the electrostatic latent images;

at least the surface of the toner-holding member containing 10% by weight or more of at least one member selected from the group consisting of polyphenylene oxide, polycarbonate, styrene type resin, silicone resin having a three-dimensional structure, polymer of vinyl ester type monomer, silane compound, and polyethersulfone.

6. A method according to claim 5 in which the finely divided particles of the inorganic polymer of carbon fluoride is contained in an amount of 1–60% by weight.

7. Apparatus for developing electrostatic latent images comprising a toner-holding member for imparting triboelectric charges to a toner without the use of carrier particles, a supply of highly insulating toner, having a conductivity on the order of $10^{-14}$ mhos/cm or lower, for supplying toner to said toner-holding member, means for adjusting the thickness of the toner layer on the toner-holding member from said toner supply to a value smaller than the distance between the surface of the latent image holding member and the surface of the toner-holding member, and means for moving said toner-holding member and supplying said toner to said latent images for development thereof, in which at least the surface of said toner-holding member contains at least one material selected from the group consisting of polyphenylene oxide, polycarbonate, styrene type resin, silicone resin having a three-dimensional structure, polymer of vinyl ester type monomer, silane compound, and polyethersulfone.

8. Apparatus according to claim 7 in which means are provided for forming a magnetic field on the surface of the toner-holding member.

9. Apparatus according to claim 7 in which at least the surface of the toner-holding member contains 50% by weight or more of at least one material selected from the group consisting of polyphenylene oxide, polycarbonate, styrene type resin, silicon resin having a three-dimensional structure, polymer of vinyl ester type monomer, silane compound, and polyethersulfone.

10. Apparatus for developing electrostatic latent images comprising a toner-holding member for imparting triboelectric charges to a toner without the use of carrier particles, means for supplying a toner to said toner-holding member, means for adjusting the thickness of the toner layer on the toner-holding member to a value smaller than the distance between the surface of the latent image holding member and the surface of the toner-holding member, and means for moving said toner-holding member and supplying said toner to said latent images for development thereof, in which at least the surface of said toner-holding member contains at least one material selected from the group consisting of polyphenylene oxide, polycarbonate, styrene type resin, silicone resin having a three-dimensional structure, polymer of vinyl ester type monomers, silane compound, and polyethersulfone and finely powdered, inorganic polymer of carbon fluoride is contained in the surface of said toner-holding member.

11. Apparatus according to claim 10 in which finely divided particles of the inorganic polymer of carbon fluoride are contained in an amount of 1–60% by weight.

12. Apparatus according to claim 8, in which the toner is a magnetic toner.

* * * * *

UNITED STATES PATENT AND TRADEMARK OFFICE

CERTIFICATE OF CORRECTION

PATENT NO. : 4,522,907

DATED : June 11, 1985

INVENTOR(S) : YASUO MITSUHASHI, ET AL.

It is certified that error appears in the above-identified patent and that said Letters Patent is hereby corrected as shown below:

Column 2, line 7, "inadvantageous" should read --disadvantageous--;
line 27, "inadvantageous" should read --disadvantageous--.

Column 3, line 33, "tha" should read --that--.

Column 6, line 46, "compounds" should read --compound--.

Column 7, line 30, "have to" should read --having--.

Column 10, line 27, change "wxs" to --wax--.

Column 15, line 6, "described that" should read --that described--;
line 60, "acetated" should read --acetate--.

Column 16, line 15, "bruch" should read --brush--.

Signed and Sealed this

*Twenty-fifth* Day of *February 1986*

[SEAL]

*Attest:*

DONALD J. QUIGG

*Attesting Officer*

*Commissioner of Patents and Trademarks*